US007137730B2

(12) United States Patent
Eck et al.

(10) Patent No.: US 7,137,730 B2
(45) **Date of Patent: *Nov. 21, 2006**

(54) ELECTROGRAPHIC RIBBON BLENDER AND METHOD

(75) Inventors: Edward Michael Eck, Lima, NY (US); Wendy Sue Buhay-Kettelkamp, Clifton Springs, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/949,641

(22) Filed: Sep. 24, 2004

(65) Prior Publication Data

US 2005/0068849 A1 Mar. 31, 2005

Related U.S. Application Data

(60) Provisional application No. 60/506,131, filed on Sep. 26, 2003.

(51) Int. Cl.
*B01F 7/08* (2006.01)
*G03G 15/08* (2006.01)

(52) U.S. Cl. ..... 366/320; 366/312; 366/319; 366/321; 366/322; 399/256

(58) Field of Classification Search ..... 366/318–324, 366/325.3, 327.4, 310, 312–313; 399/254–256
See application file for complete search history.

(56) References Cited

U.S. PATENT DOCUMENTS 1,001,508 A * 8/1911 Craig ..... 366/192
3,138,167 A * 6/1964 Fisher ..... 134/145
3,292,911 A * 12/1966 Paul ..... 366/313
3,380,716 A * 4/1968 Arter ..... 366/313
3,877,881 A * 4/1975 Ono et al. ..... 422/135
4,610,068 A * 9/1986 Schultz ..... 366/320
4,634,286 A * 1/1987 Pike ..... 366/320
4,707,107 A * 11/1987 Joseph ..... 399/256
4,825,244 A * 4/1989 Hediger ..... 399/255
4,887,132 A * 12/1989 Joseph et al. ..... 399/256
4,956,675 A * 9/1990 Joseph ..... 399/254

(Continued)

FOREIGN PATENT DOCUMENTS

EP 0250793 A2 * 1/1988

(Continued)

*Primary Examiner*—Charles E. Cooley
(74) *Attorney, Agent, or Firm*—Donna P. Suchy

(57) ABSTRACT

According to the various aspects of the invention, a method and apparatus for mixing electrographic developer is provided. An elongate shaft having two ends and an intermediate location between the two ends is rotated. Developer is moved away from the intermediate location toward one of the ends with an inner helical ribbon mounted concentrically to the elongate shaft for rotation therewith. Developer is moved away from the one of the ends toward the intermediate location with an outer helical ribbon mounted concentrically to the elongate shaft for rotation therewith, the inner helical ribbon is disposed within the outer helical ribbon. Developer is moved away from the intermediate location toward another of the ends with another inner helical ribbon mounted to the elongate shaft for rotation therewith. Finally, developer is moved away from the another of the ends toward the intermediate location with another outer helical ribbon mounted to the elongate shaft for rotation therewith, the another inner helical ribbon is disposed within the another outer helical ribbon. The outer helical ribbon and the another outer helical ribbon are terminated to provide an opening spanning the intermediate location through which developer is drawn into the inner helical ribbon and the another inner helical ribbon upon rotation of the longitudinal shaft.

20 Claims, 5 Drawing Sheets

U.S. PATENT DOCUMENTS

| | | | | |
|---|---|---|---|---|
| 4,980,724 | A * | 12/1990 | Tanaka | 399/256 |
| 5,144,892 | A * | 9/1992 | Tupek et al. | 101/363 |
| 5,146,277 | A * | 9/1992 | Fox et al. | 399/254 |
| 5,400,124 | A | 3/1995 | Kass et al. | |
| 5,876,117 | A * | 3/1999 | Chen | 366/320 |
| 6,585,406 | B1 | 7/2003 | Toepper et al. | |
| 2001/0046182 | A1* | 11/2001 | Toepper et al. | 366/320 |
| 2005/0068849 | A1* | 3/2005 | Eck et al. | 366/325.3 |
| 2005/0123321 | A1* | 6/2005 | Buhay-Kettelkamp et al. | 399/254 |

FOREIGN PATENT DOCUMENTS

| | | | |
|---|---|---|---|
| GB | 2060421 A | * | 5/1981 |
| JP | 62-114637 | * | 5/1987 |
| JP | 2-135137 | * | 5/1990 |
| JP | 3-118827 | * | 5/1991 |
| SU | 1331546 | * | 8/1987 |

* cited by examiner

ELECTROGRAPHIC RIBBON BLENDER AND METHOD

BACKGROUND

This invention relates generally to development apparatus for mixing and applying developer material to a latent image on an image-bearing member in an electrographic reproduction machine, such as a copier or printer. More particularly, this invention relates to a blender of the type for mixing electrographic developer comprising a plurality of blender segments mounted on a shaft.

Development apparatus, for example a magnetic brush development apparatus, are well known for mixing and applying developer material to a latent electrostatic image on a photoconductor in an electrographic reproduction machine such as a copier or printer. Such a development apparatus typically includes an elongate housing which has a sump portion for containing the developer material. A two-component developer material comprises a mixture of carrier particles and toner particles. These particles are usually moved and mixed by a mixing device in the sump portion of the housing for triboelectrically charging the particles. Mixing also promotes uniformity in the concentration of toner particles throughout the sump portion, and in the distribution of developer material within the sump. The mixed and charged developer material can then be fed from the sump portion for development of the latent image on the photoconductor, which is generally a film or drum.

The quality of such an image development depends, in significant part, on factors such as the level of charge on the toner particles achieved triboelectrically for example, and such as the level and uniformity of the concentration of toner particles in the developer material being applied. As is well known, these factors are mainly determined by the effectiveness of a mixing device used in the sump portion of the development apparatus housing for moving, mixing and charging the developer material particles.

SUMMARY OF THE INVENTION

In accordance with an object of the invention, both an apparatus and a method are provided for mixing and applying developer material to a latent image on an image-bearing member in an electrographic reproduction machine, such as a copier or printer using a blender with a plurality of blender segments mounted on a shaft.

The blender for mixing electrographic developer having an elongate shaft with two ends and an intermediate location between the two ends. Developer is moved away from the intermediate location toward one of the ends with an inner helical ribbon mounted concentrically to the elongate shaft for rotation therewith. The developer is moved away from the one of the ends toward the intermediate location with an outer helical ribbon mounted concentrically to the elongate shaft for rotation therewith, the inner helical ribbon is disposed within the outer helical ribbon and is moved away from the intermediate location toward another of the ends with another inner helical ribbon mounted to the elongate shaft for rotation therewith. Finally, developer is moved away from the ends toward the intermediate location with another outer helical ribbon mounted to the elongate shaft for rotation therewith, the another inner helical ribbon is disposed within the another outer helical ribbon. The outer helical ribbon and the another outer helical ribbon are terminated to provide an opening spanning the intermediate location through which developer is drawn into the inner helical ribbon and the another inner helical ribbon upon rotation of the longitudinal shaft.

While the specification concludes with claims particularly pointing out and distinctly claiming the subject matter of the present invention, it is believed the invention will be better understood from the following detailed description when taken in conjunction with the accompanying drawings.

DETAILED DESCRIPTION

Figure 1:
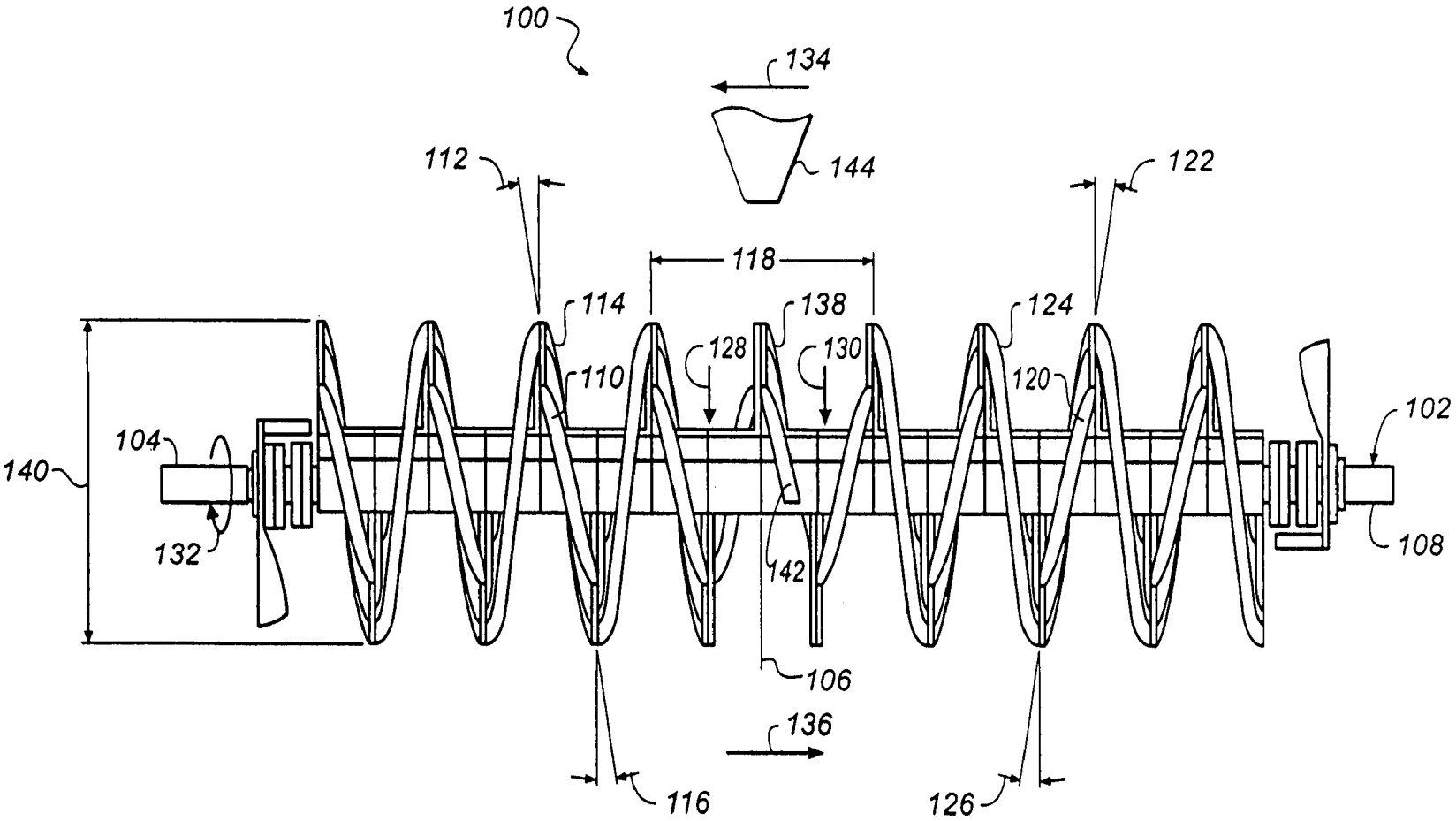
FIG. 1 presents a side view of a blender according to an aspect of the invention.

Various aspects of the invention are presented in FIGS. 1–4, which are not drawn to any particular scale, and wherein like components in the numerous views are numbered alike. As used herein, the terms "comprising", "having", and "including" are intended to have an open-ended meaning. Referring now to FIG. 1, a blender 100 for mixing electrographic developer is presented, according to an aspect of the invention. Blender 100 comprises an elongate shaft 102 having two ends 104 and 108 and an intermediate location 106 between the two ends 104 and 108. An inner helical ribbon 110 is mounted concentrically to the elongate shaft 102 for rotation therewith and having a pitch 112. An outer helical ribbon 114 is mounted concentrically to the elongate shaft 102 for rotation therewith and has an opposite pitch 116 relative to the pitch 112. The inner helical ribbon 110 is disposed within the outer helical ribbon 114.

Another inner helical ribbon 120 mounted to the elongate shaft 102 for rotation therewith adjacent to the inner helical ribbon 110 and has another pitch 122. Another outer helical ribbon 124 is mounted to the elongate shaft 102 for rotation therewith adjacent to the outer helical ribbon 114 and has another opposite pitch 126 relative to the another pitch 122. The another inner helical ribbon 120 is disposed within the another outer helical ribbon 124.

The outer helical ribbon 114 and the another outer helical ribbon 124 are terminated to provide an opening 118 spanning the intermediate location 106 through which developer is drawn into said inner helical ribbon 110 and the another inner helical ribbon 120 (indicated by arrows 128 and 130) upon rotation of the longitudinal shaft (indicated by arrow 132).

The pitch 112 and the another opposite pitch 126 are in a same direction 134 relative to the elongate shaft 106. The another pitch 122 and the opposite pitch 116 are in another same direction 136 opposite to the same direction 136. The magnitudes of the various pitches may or may not be the same. According to a preferred embodiment, the magnitudes of pitches 112 and 122 are equal, and the magnitudes of pitches 116 and 126 are equal.

In FIG. 1, at 138, the another inner helical ribbon 120 transitions to the outer helical ribbon diameter 140 of the outer helical ribbons ribbon 114 and 124. This is completely optional. Alternatively, the inner helical ribbon 110 could just as easily transition to the outer helical ribbon diameter 140. Therefore, according to a further aspect of the invention, blender 100 may comprise one of the inner helical ribbon 110 transitioning to the outer helical ribbon diameter 140 and the another inner helical ribbon 120 transitioning to said outer helical ribbon diameter 140.

Furthermore, at 142, inner helical ribbon 110 partially transitions to the outer helical ribbon diameter 140. The another inner helical ribbon could be configured in like manner. Regardless, at least one of the inner helical ribbon 110 and the another helical ribbon 120 may be configured in such manner. Therefore, according to a further aspect of the invention, the blender 100 may comprise at least one of the inner helical ribbon 110 partially transitioning to the outer helical ribbon diameter 140 and the another inner helical ribbon 120 partially transitioning to the outer helical ribbon diameter 140.

The blender 100 of FIG. 1 may be fabricated from the blender of FIGS. 7–14 of U.S. Pat. No. 6,585,406 entitled Electrostatographic Blender Assembly and Method, issued Jul. 1, 2003, the contents of which are fully incorporated by reference as if set forth herein, by cutting unwanted sections of the helical ribbons away. Any method of cutting is suitable, for example with hand operated dikes.

Figure 2:
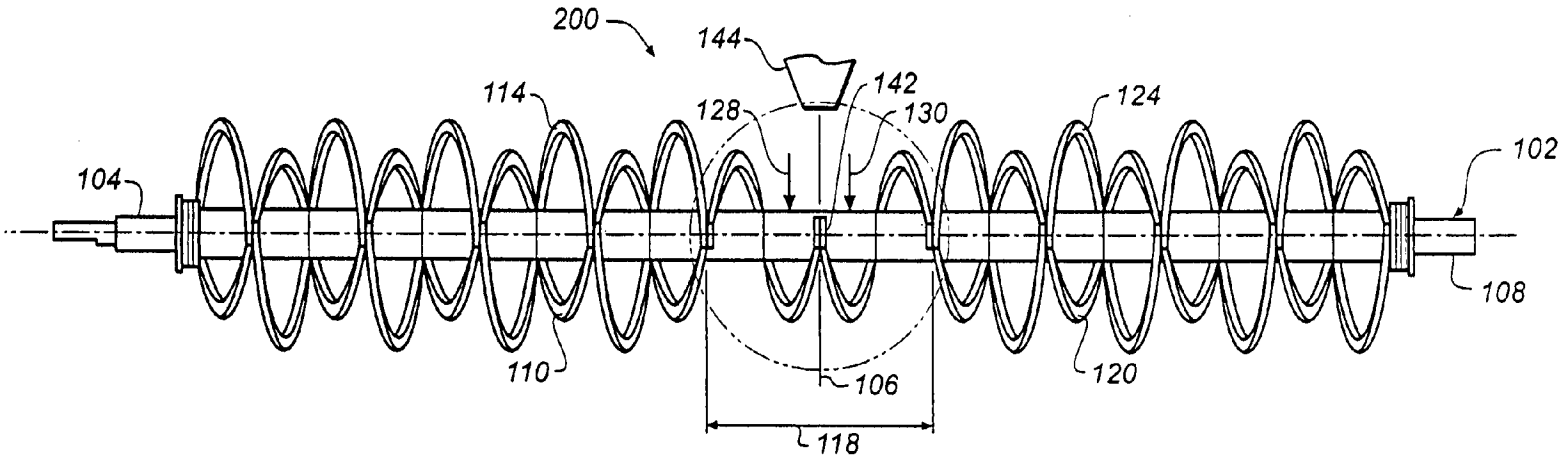
FIG. 2 presents a side view of a blender according to an aspect of the invention.
Figure 3:
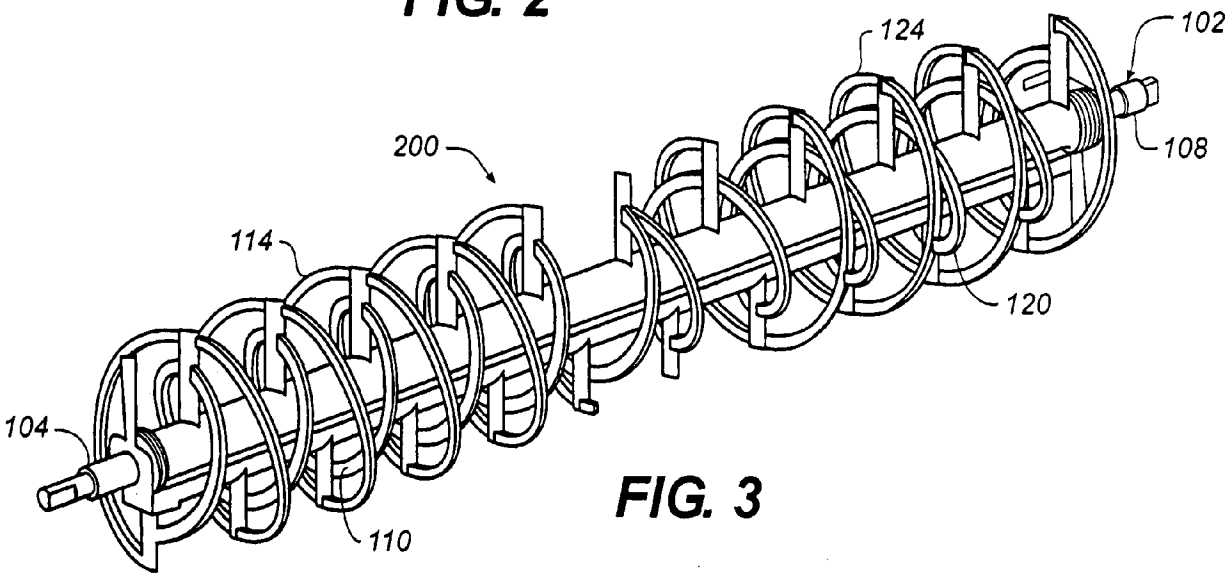
FIG. 3 presents a perspective view of the FIG. 2 blender.

Referring now to FIGS. 2 and 3, a blender 200 generally similar to blender 100 is presented. As shown in FIGS. 2 and 3, the inner helical ribbon 114 and the another inner helical ribbon 124 may terminate at the intermediate location 106. The inner helical ribbon 114 and the another inner helical ribbon 124 may meet at the intermediate location, and may form a plow 142. Or, as shown in FIG. 1, the inner helical ribbon 114 and the another inner helical ribbon 124 may not meet at the intermediate location 106.

The blender 100 and 200 generally provides a flow pattern of developer as described in U.S. Pat. No. 4,634,286 entitled Electrographic Development Apparatus Having a Continuous Coil Ribbon Blender, issued Jan. 6, 1987, and particularly FIG. 3 thereof. The helical ribbons 114, 124, 116 and 126 may be continuous or piecewise continuous, as described in U.S. Pat. Nos. 4,610,068; 4,887,132; 4,956,675; 5,146,277; 4,634,286; 6,585,406; and similar structures as may be expedient.

According to a further aspect of the invention, a method for mixing electrographic developer is provided, comprising rotating an elongate shaft 120 having two ends 104 and 108 and an intermediate location 106 between the two ends 104 and 108, moving developer with an inner helical ribbon 110 mounted concentrically to the elongate shaft 102 for rotation therewith and having a pitch 112, moving developer with an outer helical ribbon 114 mounted concentrically to the elongate shaft 102 for rotation therewith and having an opposite pitch 116 relative to the pitch 112, the inner helical ribbon being disposed within the outer helical ribbon, moving developer with another inner helical ribbon 120 mounted to the elongate shaft 102 for rotation therewith adjacent to the inner helical ribbon 110 and having another pitch 112, moving developer with another outer helical ribbon 124 mounted to the elongate shaft 102 for rotation therewith adjacent to the outer helical ribbon 114 and having another opposite pitch 126 relative to the another pitch 116, the another inner helical ribbon 120 being disposed within the another outer helical ribbon 124, the outer helical ribbon 114 and the another outer helical ribbon 124 being terminated to provide an opening 118 spanning the intermediate location 106 through which developer is drawn into the inner helical ribbon 110 and the another inner helical ribbon 120 upon rotation of the longitudinal shaft 102.

According to a further aspect of the invention, a method is provided for mixing electrographic developer, comprising rotating an elongate shaft 102 having two ends 104 and 108 and an intermediate location 106 between the two ends 104 and 108, moving developer away from the intermediate location 106 toward one of the ends 104 with an inner helical ribbon 110 mounted concentrically to the elongate shaft 102 for rotation therewith, moving developer away from the one of the ends 104 toward the intermediate location 106 with an outer helical ribbon 114 mounted concentrically to the elongate shaft 102 for rotation therewith, the inner helical ribbon 110 being disposed within the outer helical ribbon 114, moving developer away from the intermediate location 106 toward another of the ends 108 with another inner helical ribbon 120 mounted to the elongate shaft 102 for rotation therewith, moving developer away from the another of the ends 108 toward the intermediate location 106 with another outer helical ribbon 124 mounted to the elongate shaft 102 for rotation therewith, the another inner helical ribbon 120 being disposed within the another outer helical ribbon 124, the outer helical ribbon 114 and the another outer helical ribbon 124 being terminated to provide an opening 118 spanning the intermediate location 106 through which developer is drawn into the inner helical ribbon 110 and the another inner helical ribbon 120 upon rotation of the longitudinal shaft 102.

The invention preferably comprises adding toner to the developer proximate the intermediate location 106, for example by a toner replenisher 144. As used herein, the term "proximate the intermediate location" means that the toner is preferentially drawn into the inner ribbon 110 and the another inner ribbon 120 through the opening 120. This greatly improves homogeneity of toner concentration in the developer mix and resulting homogeneity of toner density of a developed electrostatic image on an electrographic film. The invention has been found to eliminate a strip of greater toner density in the center section of a developed electrostatic image.

Figure 4:
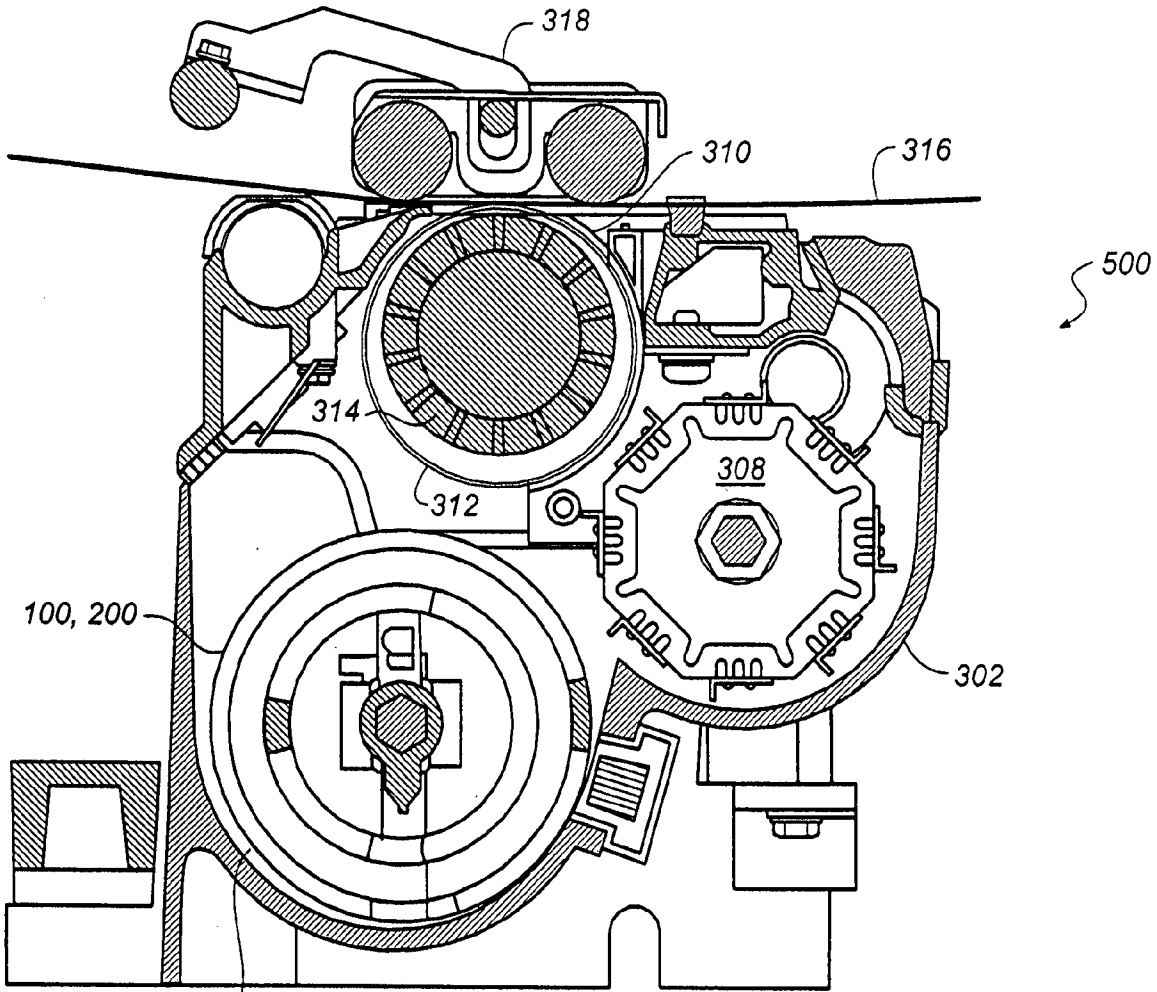
FIG. 4 presents a cross-sectional view of an electrographic developer apparatus according to an aspect of the invention.

Referring now FIG. 4, a cross-sectional view of an electrographic developing apparatus 300 is presented implementing a blender according to the invention, for example blenders 100 and 200. Toning station 300 comprises a housing 302 that defines a developer sump 304 containing a developer (not shown) that is a mixture of toner and hard magnetic carriers of a type described in U.S. Pat. No. 4,546,060. The ribbon blender (100, 200, for example) is rotated in the sump 304. The ribbon blender mixes and agitates the developer keeping it well mixed and also promoting tribocharging of the carrier and toner particles constituting the developer. A developer feed mechanism 308 lifts developer from the sump 304 to a magnetic brush 310. The magnetic brush is of a type described in U.S. Pat. No. 4,546,060 and comprises a toning shell 312 configured to rotate, and a core 314 having a plurality of magnets of alternating polarity that upon rotation of the core 314 cause the carrier particles to rotate in an opposite direction in an advancing nap coating the toning shell 312, as is well known in the art. The toning shell 312 may be rotated to contribute to the motion of the nap, again, as is well known in the art.

The advancing nap (not shown), constituting a magnetic brush, contacts a film 316 having a latent electrostatic image, generally a photoconductor as is known in the electrophotographic arts, and toner is attracted from the magnetic brush (developer) to the film 316 as it is advanced over the magnetic brush, thereby developing the image thereon. A backer bar 318 retains the film 316 in proper position relative to the toning shell, and in contact with the magnetic brush. The developer falls back into the sump 304. The blender according to the invention is preferably formed from a metal, for example aluminum.

The carrier particles may comprise hard magnetic carrier particles. In such case, the magnetic brush may operate according to the principles described in U.S. Pat. Nos. 4,473,029 and 4,546,060, the contents of which are fully incorporated by reference as if set forth herein. The two-component dry developer composition of U.S. Pat. No. 4,546,060 comprises charged toner particles and oppositely charged, magnetic carrier particles, which (a) comprise a magnetic material exhibiting "hard" magnetic properties, as characterized by a coercivity of at least 300 gauss and (b) exhibit an induced magnetic moment of at least 20 EMU/gm when in an applied field of 1000 gauss, is disclosed. As described in the '060 patent, the developer is employed in combination with a magnetic applicator comprising a rotatable magnetic core and an outer, nonmagnetizable shell to develop electrostatic images. When hard magnetic carrier particles are employed, exposure to a succession of magnetic fields emanating from the rotating core applicator causes the particles to flip or turn to move into magnetic alignment in each new field. Each flip, moreover, as a consequence of both the magnetic moment of the particles and the coercivity of the magnetic material, is accompanied by a rapid circumferential step by each particle in a direction opposite the movement of the rotating core. The observed result is that the developers of the '060 flow smoothly and at a rapid rate around the shell while the core rotates in the opposite direction, thus rapidly delivering fresh toner to the photoconductor and facilitating high-volume copy and printer applications. The invention is equally applicable for mixing developers having other types of carriers, for example, soft magnetic carriers.

Figure 5:
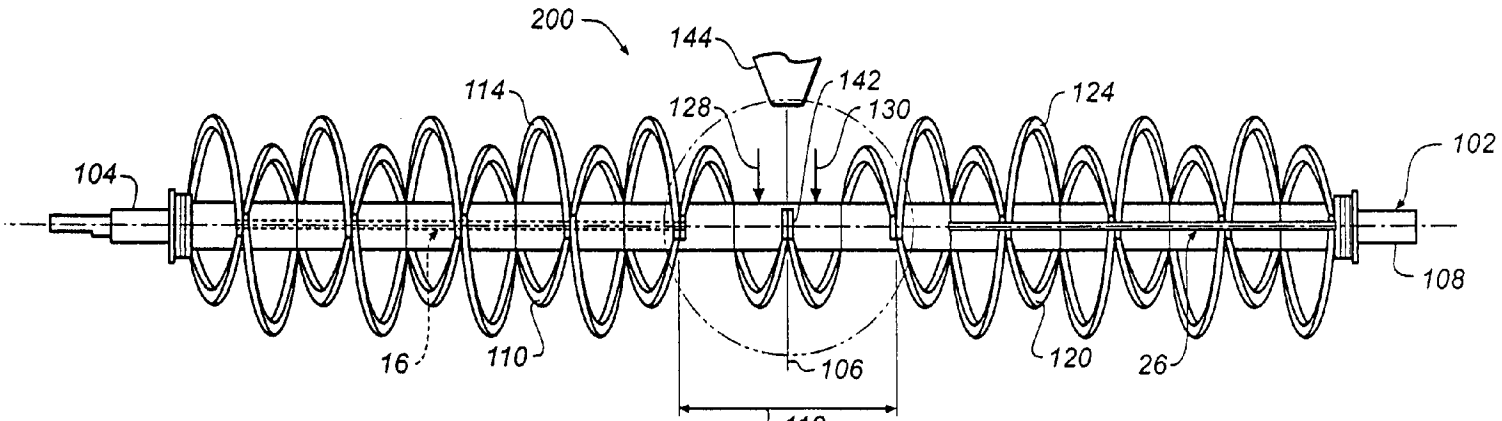
FIG. 5 presents a side view of blender according to a preferred embodiment.
Figure 6:
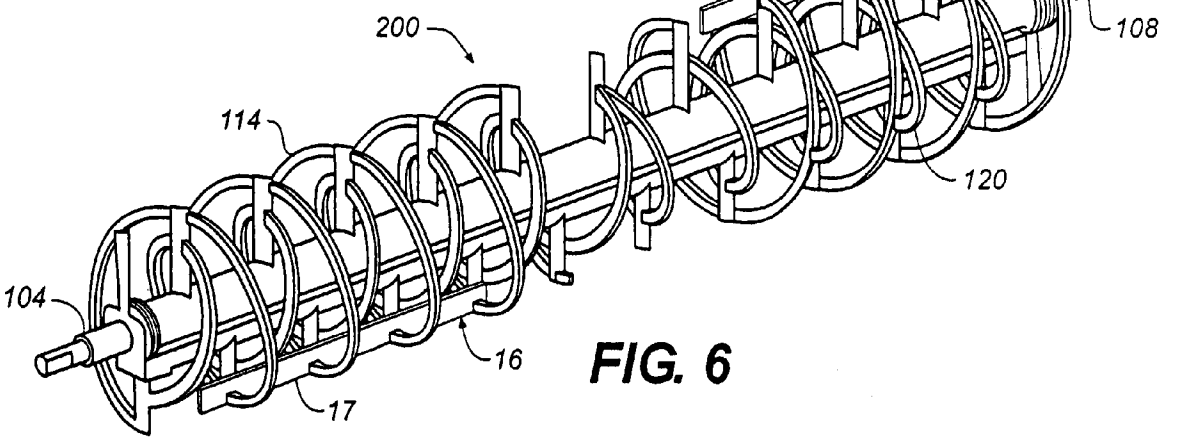
FIG. 6 presents a perspective view of the FIG. 5 blender.

Referring now to FIGS. 5 and 6, a preferred embodiment is presented wherein the blender 200 is provided with a skive 16 and another skive 26 that may be mounted to the blender 200 using tie-wraps. The skives 16 and 17 define outer edges that are preferably offset radially inward from the outer surfaces of the helical ribbons 114, 110, 120, and 124 a small distance, for example 0.060 inches±0.030 inches. The overhang of the skives 16 and 17 terminate at some of the spokes, and overhang past others of the spokes, as shown in FIGS. 5 and 6. This arrangement may prevent image streaking, a consideration in the practice of the invention. The skives 16 and 17 are described more fully in U.S. patent application Ser. No. 10/949,645 entitled "ELECTROGRAPHIC BLENDER AND METHOD A SKIVE", filed on Sep. 24, 2004, in the names of Edward Michael Eck and Wendy Sue Buhay-Kettelkamp, the contents of which are fully incorporated by reference as if set forth herein.

The toner particles may comprise MICR (Magnetic Ink Character Recognition) toner particles. A suitable MICR toner is described in U.S. Pat. No. 6,610,451 entitled "DEVELOPMENT SYSTEMS FOR MAGNETIC TONERS HAVING REDUCED MAGNETIC LOADINGS", with about 23% iron oxide and 8% olfeinic wax by weight, and a silica surface treatment. The U.S. Pat. No. 6,610,451 patent is incorporated by reference as if fully set forth herein. A polymethylmethacrylate surface treatment may also be implemented, for example catalogue number MP1201 available from Soken Chemical & Engineering Co., Ltd., Tokyo, Japan, and distributed by Esprix Technologies of Sarasota, Fla. The carrier particles may be SrFe12019 coated with polymethylmethacrylate. Volume mean diameter of 20.5 microns (sigma=0.7 microns for ten production runs of a carrier material), measured using an Aerosizer particle sizing apparatus (TSI Incorporated of Shoreview, Minn.). A suitable carrier has a coercivity of 2050 Gauss, a saturation magnetization of 55 emu/g, and a remnance of 32 emu/g, measured using an 8 kG loop on a Lake Shore Vibrating Sample Magnetometer (Lake Shore Cryotronics, Inc., of Westerville, Ohio).

Figure 7:
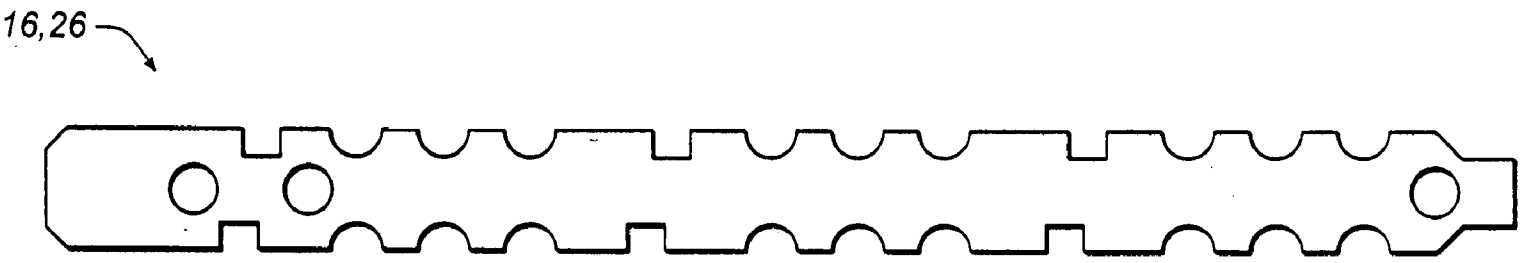
FIG. 7 presents a plan view of a skive that may be implemented in the practice of the invention.

The sump in an electrographic developing apparatus 300 may have an average roughness of ten readings of 70 microinches (Ra)±20, with none of the ten readings being less than 20 microinches (Ra) or more than 120 microinches (Ra), and 35 microinches (Ra) in the area of the toner monitor. The apparatus 300 may comprise a ribbon blender having an outside diameter of 2.760 inch, a toning shell having an outside diameter of 1.996 inch, a magnetic core of 1.700 inch. The magnetic core may have 14 magnets, a maximum magnetic field strength of 950 gauss and a minimum magnetic field strength of 850 gauss. At 110 pages per minute the ribbon blender may rotate 355 RPM, the toning shell may rotate at 129.1 RPM, and the magnetic core may rotate at 1141 RPM. At 150 pages per minute the ribbon blender may rotate 484 RPM, the toning shell may rotate at 176 RPM, and the magnetic core may rotate at 1555.9 RPM. FIG. 7 presents a plan view of a skive that may be implemented in the practice of the invention. The scalloped edges may improve mixing of the developer.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

The invention claimed is:

1. A blender for mixing electrographic developer, comprising:

an elongate shaft having two ends and an intermediate location between said two ends;

an inner helical ribbon mounted concentrically to said elongate shaft for rotation therewith and having a pitch;

an outer helical ribbon mounted concentrically to said elongate shaft for rotation therewith and having an opposite pitch relative to said pitch, said inner helical ribbon being disposed within said outer helical ribbon;

another inner helical ribbon mounted to said elongate shaft for rotation therewith adjacent to said inner helical ribbon and having another pitch;

another outer helical ribbon mounted to said elongate shaft for rotation therewith adjacent to said outer helical ribbon and having another opposite pitch relative to said another pitch, said another inner helical ribbon being disposed within said another outer helical ribbon;

said outer helical ribbon and said another outer helical ribbon being terminated to provide an opening spanning said intermediate location through which developer is drawn into said inner helical ribbon and said another inner helical ribbon upon rotation of said longitudinal shaft.

2. The blender of claim 1, said inner helical ribbon and said another inner helical ribbon terminating at said intermediate location.

3. The blender of claim 1, said pitch and said another opposite pitch being in a same direction relative to said elongate shaft, said another pitch and said opposite pitch being in another same direction opposite to said same direction.

4. The blender of claim 1, said inner helical ribbon and said another inner helical ribbon meeting at said intermediate location.

5. The blender of claim 1, said inner helical ribbon and said another inner helical ribbon not meeting at said intermediate location.

6. The blender of claim 1, said inner helical ribbon and said another inner helical ribbon meeting at said intermediate location in the form of a plow.

7. The blender of claim 1, one of said inner helical ribbon transitioning to an outer helical ribbon diameter and said another inner helical ribbon transitioning to said outer helical ribbon diameter.

8. The blender of claim 1, at least one of said inner helical ribbon partially transitioning to an outer helical ribbon diameter and said another inner helical ribbon partially transitioning to said outer helical ribbon diameter.

9. A method for mixing electrographic developer, comprising:

rotating an elongate shaft having two ends and an intermediate location between said two ends;

moving developer with an inner helical ribbon mounted concentrically to said elongate shaft for rotation therewith and having a pitch;

moving developer with an outer helical ribbon mounted concentrically to said elongate shaft for rotation therewith and having an opposite pitch relative to said pitch, said inner helical ribbon being disposed within said outer helical ribbon;

moving developer with another inner helical ribbon mounted to said elongate shaft for rotation therewith adjacent to said inner helical ribbon and having another pitch;

moving developer with another outer helical ribbon mounted to said elongate shaft for rotation therewith adjacent to said outer helical ribbon and having another opposite pitch relative to said another pitch, said another inner helical ribbon being disposed within said another outer helical ribbon;

said outer helical ribbon and said another outer helical ribbon being terminated to provide an opening spanning said intermediate location through which developer is drawn into said inner helical ribbon and said another inner helical ribbon upon rotation of said longitudinal shaft.

10. The method of claim 9, said inner helical ribbon and said another inner helical ribbon terminating at said intermediate location.

11. The method of claim 9, said pitch and said another opposite pitch being in a same direction relative to said elongate shaft, said another pitch and said opposite pitch being in another same direction opposite to said same direction.

12. The method of claim 9, said inner helical ribbon and said another inner helical ribbon meeting at said intermediate location.

13. The method of claim 9, said inner helical ribbon and said another inner helical ribbon not meeting at said intermediate location.

14. The method of claim 9, said inner helical ribbon and said another inner helical ribbon meeting at said intermediate location in the form of a plow.

15. The method of claim 9, one of said inner helical ribbon transitioning to an outer helical ribbon diameter and said another inner helical ribbon transitioning to said outer helical ribbon diameter.

16. The method of claim 9, at least one of said inner helical ribbon partially transitioning to an outer helical ribbon diameter and said another inner helical ribbon partially transitioning to said outer helical ribbon diameter.

17. The method of claim 9, and adding toner to said developer proximate said intermediate location.

18. A method for mixing electrographic developer, comprising:

rotating an elongate shaft having two ends and an intermediate location between said two ends;

moving developer away from said intermediate location toward one of said ends with an inner helical ribbon mounted concentrically to said elongate shaft for rotation therewith;

moving developer away from said one of said ends toward said intermediate location with an outer helical ribbon mounted concentrically to said elongate shaft for rotation therewith, said inner helical ribbon being disposed within said outer helical ribbon;

moving developer away from said intermediate location toward another of said ends with another inner helical ribbon mounted to said elongate shaft for rotation therewith;

moving developer away from said another of said ends toward said intermediate location with another outer helical ribbon mounted to said elongate shaft for rotation therewith, said another inner helical ribbon being disposed within said another outer helical ribbon;

said outer helical ribbon and said another outer helical ribbon being terminated to provide an opening spanning said intermediate location through which developer is drawn into said inner helical ribbon and said another inner helical ribbon upon rotation of said longitudinal shaft.

19. The method of claim 18, and adding toner to said developer proximate said intermediate location.

20. The method of claim 18, said inner helical ribbon and said another inner helical ribbon terminating at said intermediate location.

* * * * *